United States Patent [19]

Tashiro et al.

[11] Patent Number: 4,900,985

[45] Date of Patent: Feb. 13, 1990

[54] HIGH-VOLTAGE INPUT TERMINAL STRUCTURE OF A MAGNETRON FOR A MICROWAVE OVEN

[75] Inventors: Norio Tashiro; Masaki Adachi, both of Yokohama; Toshio Ikeda, Ebina; Hisao Saito, Fujisawa; Saburo Matsushita, Kanagawa; Masataka Komine, Yokohama, all of Japan

[73] Assignee: Kabushiki Kaisha Toshiba, Kawasaki, Japan

[21] Appl. No.: 126,229

[22] Filed: Nov. 27, 1987

[30] Foreign Application Priority Data

Nov. 29, 1986 [JP] Japan ..... 61-284531
Jul. 13, 1987 [JP] Japan ..... 62-174116

[51] Int. Cl.[4] ..... H01J 25/50

[52] U.S. Cl. ..... 315/39.51; 315/39.0; 315/39.63; 315/85

[58] Field of Search ..... 315/39.51, 39.63, 39.61, 315/39.65, 39.53, 39.0, 85

[56] References Cited

U.S. PATENT DOCUMENTS 4,131,824 12/1978 Nakai et al. ..... 315/39.51
4,752,720 6/1988 Oguro et al. ..... 315/39.51
4,772,823 9/1988 Matsuzaki et al. ..... 315/39.51
4,797,596 1/1989 Tsuzurahara ..... 315/39.0

FOREIGN PATENT DOCUMENTS 0178843 4/1986 European Pat. Off. .
50-58634 5/1975 Japan .
56-662 1/1981 Japan .
60-129058 7/1985 Japan .
60-243939 12/1985 Japan .
60-243940 12/1985 Japan .
60-243941 12/1985 Japan .
60-243942 12/1985 Japan .

*Primary Examiner*—Donald J. Yusko
*Assistant Examiner*—Brian S. Palladino
*Attorney, Agent, or Firm*—Cushman, Darby & Cushman

[57] ABSTRACT

In a magnetron for microwave oven, a high-voltage input terminal structure 30 is provided on a shield box 26 mounted on a magnetron unit 22. The high-voltage input terminal structure 30 has a cylindrical earth electrode 33, a cylindrical high potential inner electrode 32 and a central conductor 31*a*. The cylindrical earth electrode 33 is secured to the shield box 26 and the cylindrical high potential inner electrode 32 is coaxially arranged in the cylindrical earth electrode 33. The central conductor 31*a* is connected through an inductor 28 to a cathode lead 27 of the magnetron unit 22. An insulating resin 34*b* is filled in a gap between the cylindrical earth electrode 33 and the highpotential electrode 32 to form a capacitor section C. Cylindrical insulating sheaths 37, 38 are formed by the resin on the both sides of the capacitor section C. The capacitor section C and the cylindrical insulating sheaths, 37, 38 are integrally formed and continuously extended along a straight line.

18 Claims, 11 Drawing Sheets

HIGH-VOLTAGE INPUT TERMINAL STRUCTURE OF A MAGNETRON FOR A MICROWAVE OVEN

BACKGROUND OF THE INVENTION

This invention relates to a magnetron for a microwave oven. More specifically, this invention concerns the improvements in the structure of a high-voltage input terminal which is secured to the shield box of a magnetron.

In magnetrons for microwave ovens, a negative high voltage to be given to the filament cathode is applied to the cathode input stem, to which power for heating is also supplied. In a magnetron for use in a microwave oven for household use, for example, the anode voltage is 4 kV, the anode current is 300 mA, the filament voltage is 3.15 V, and the filament current is 10 A. For high-voltage terminals used to introduce high voltages and large currents such as mentioned above, a feed-through-type high-voltage capacitor structure, in which a ceramic high dielectric element is built, is generally adopted. In high-voltage terminals of this structure which serves as the input terminal, a feed-through-type high-voltage capacitor has an electrostatic capacity of several hundreds of pF, and forms an LC filter in combination with a choke coil to thereby suppress noise that is generated by the magnetron.

The dielectric characteristics of the high dielectric element, to which a high voltage is applied, is considered particularly important to a magnetron. Generally, the high dielectric element is covered by an insulating resin to protect the interface. This adds necessary steps to the production process. Moreover, it is considered very difficult to implement quality control in terms of dielectric strength. For this reason, efforts are being made to simplify the structure of the high-voltage input terminal insofar as possible. There are limitations in simplification of the structure of the high-voltage input terminal so long as high dielectric elements are used. A possible very simplified example is a high-voltage input terminal in a structure that can withstand high voltages by use of a thin layer of insulating resin and also has an electrostatic capacity.

Molding can be used for integration of a plurality of electrodes with an insulating resin, which are the component parts of a high-voltage input terminal. However, since the thermal expansion coefficient of an electrode metal is smaller than that of an insulating resin, there is a possibility that the resin cracks when it is subjected to a heat cycle, etc. This possibility is high particularly when the resin is subjected to a tensile stress. In magnetrons for electronic ranges, above all, since the choke coil which is an input conductor and the shield box are raised to high temperatures when in service, the input terminal connected to them is sometimes heated to 100° C. Therefore, the resin used in the input terminal of a magnetron for a microwave oven is required to have a sufficient heat resistance. When the insulating resin portion is formed by molding, if the insulating resin is used in a thin layer to provide the high-voltage input terminal with an adequate electrostatic capacity, it is difficult to maintain the structure of the insulating resin after the molding in good quality, from a microscopic point of view. Also, it is relatively difficult to make the insulating resin structure withstand mechanical stresses and prevent the occurrence of voids to ensure that the dielectric performance of the insulating resin itself can be exhibited to the full.

There are known structures of the high-voltage input terminal, which are disclosed, for example, in Japanese Utility Model Disclosure Nos. 48-5652, 50-58634, 60-126963 and 60-129058. However, it has been found that if an attempt is made to obtain necessary electrostatic capacity and high dielectric strength only through elaborate contrivances about the structure of the insulating resin layer, the resin layer of uniform quality cannot be realized from a microscopic point of view, because the arrangement of the electrode parts inevitably becomes complicated and, therefore, the flow of resin during the molding becomes complex.

SUMMARY OF THE INVENTION

The object of this invention is to provide a magnetron for a microwave oven, which has an electrostatic capacity and a high dielectric performance that can be obtained by a single insulating resin molding and which is equipped with a high-voltage input terminal that is highly reliable ad particularly superior in dielectric characteristics.

According to this invention, in the high-voltage input terminal structure of a magnetron for a microwave oven, a special contrivance is employed in the shapes of the electrodes of the high-voltage input terminal and in the shape of the insulating resin molding. More specifically, the insulating resin layer constituting the capacitor portion that is formed, between a cylindrical high-potential electrode and an outer earth electrode coaxially and closely opposed thereto, by a smooth flow of resin during molding, on the one hand, and the cylindrical insulating sheaths provided extending to both sides of the above-mentioned insulating resin layer and surrounding the central conductor, on the other hand, are formed continuously substantially along a straight line. This high-voltage input terminal is secured to a wall of the shield box. Therefore, both the insulating resin between the cylindrical high-potential electrode and the outside earth electrode and the insulating resin for the cylindrical sheaths, disposed separately from but surrounding the input central conductor to increase the creeping distance, flow in molding in one direction vectorially, thus making it possible to obtain a highly reliable magnetron having a high-voltage input terminal without voids trapped in the insulating resin.

According to this invention, even if an insulating resin is filled in a relatively thin layer into the gap between the electrodes, necessary and sufficient dielectric characteristics can be obtained. More specifically, the inventors of this invention have found it important and effective in filling resin for high-voltage input terminals of this type to allow the flow of the resin in molding to be in one direction vectorially and not to permit the resin flow to be hardly accompanied by sudden changes in the flow direction and changes in the sectional area of the flow. The inventors succeeded in producing a molded insulating resin part which had a structure of good quality, as was confirmed under microscopic point of view, and could withstand mechanical stresses even though the insulating resin, which provides the high-voltage input terminal structure with an electrostatic capacity and a dielectric function, was used in a thin layer. This is because the flow of resin was designed to be in one direction vectorially. In addition, since the occurrence of voids was effectively inhibited, the insulating resin molding could fully exhibit the dielectric performance inherent in the resin itself. The central conductor is made in a non-rotation-symmetric form resembling the letter U. This U-shaped structure of the central conductor serves to prevent a change in the relative position of the faston terminal and the earth electrode, thus enabling stable and efficient molding operations.

DETAILED DESCRIPTION OF THE PREFERRED EMBODIMENTS

Figure 1:
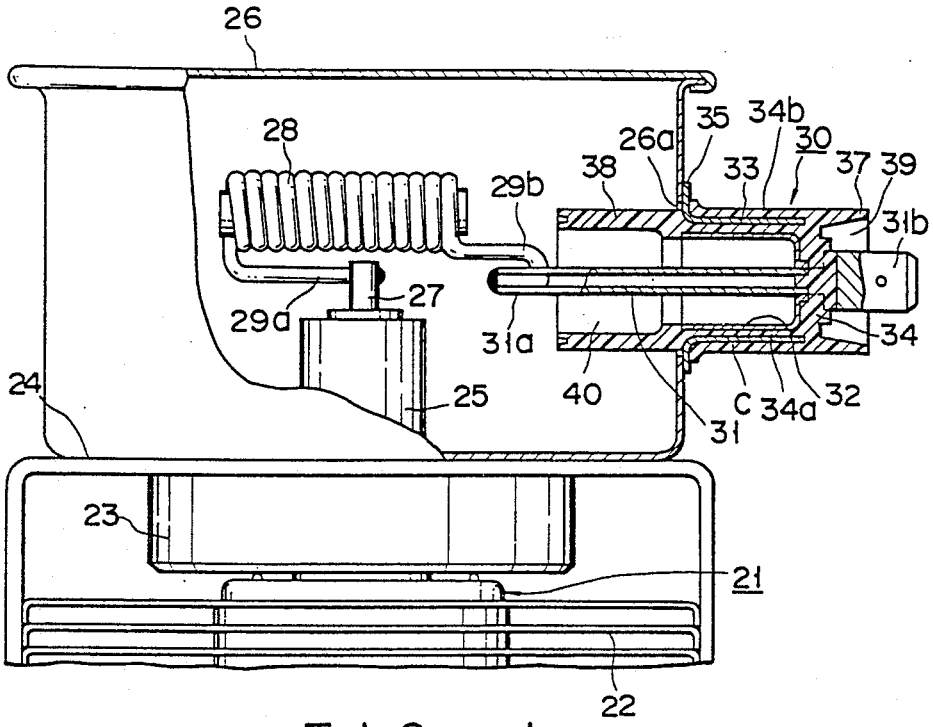
FIG. 1 is a schematic longitudinal sectional view partially in cross section of a magnetron according to an embodiment of this invention.

In this magnetron, as shown in FIG. 1, radiator 1 is secured to the outer periphery of the anode cylinder of oscillator body 21. On top of this anode cylinder, annular permanent magnet 23 is mounted. As is well known, for example, from U.S. Pat. No. 4,282,463, oscillator body 21 comprises an anode having resonant cavities (not shown), a cathode located in the center axis of the anode, a pair of pole pieces located at both openings of the anode, an output part provided at the head part of an antenna electrically connected to the anode and an input stem supporting the cathode and having a cathode lead terminal to supply the cathode with power for heating. Annular permanent magnet 23 is surrounded by ferromagnetic yoke 24. Secured to the top of the ferromagnetic yoke is shield box 26 covering input stem 25 of the oscillator body. In shield box 26, one end part 29*a* of choke coil, that is, inductor 28, is connected to cathode input terminal 27. The other end part 29*b* of the inductor is connected by welding to substantially U-shaped end part 31*a* of central conductor 31 of high-voltage input terminal 30 to which a high voltage is applied.

High-voltage input terminal 30 includes internal high-potential electrode 32 consisting of a metal cylinder, having a bottom, and connected to the central conductor, external earth electrode 33 consisting of a metal cylinder arranged outside of and coaxially with the internal high-potential electrode, a specified distance mutually separated and insulating resin 34 filling the ga between the electrodes and covering the periphery of the external earth electrode.

Figure 2:
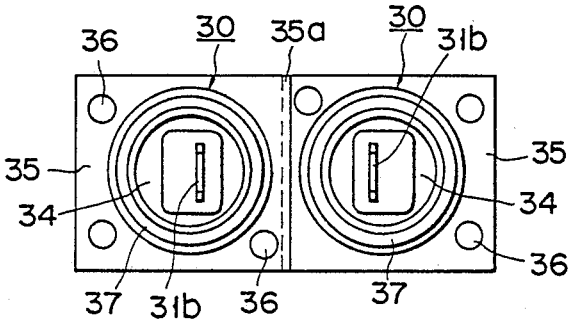
FIG. 2 is a front view showing the structure of the high-voltage input terminal of FIG. 1.

When two high-voltage input terminals are used to carry out this invention, as shown in FIG. 2, mounting flanges 35 extending sideways from the earth electrodes of the two input terminals 30 are spliced in a body, fitted in holes 26*a* of the shield box and electrically and mechanically connected and fixed. The numeral 35*a* indicates the part where the two flanges are spliced by the method which will be described later. The numeral 36 indicates holes for mounting. Faston terminals in a flat plate form constitute external end parts 31*b* of central conductors and serve as the two input terminals of this magnetron.

Each high-voltage input terminal 30 includes capacitor portion C which has the electrostatic capacity between inner high-potential electrode 32 and outer earth electrode 33, the gap between the electrodes being filled with insulating resin 34, cylindrical sheaths 37, 38 formed by the parts of insulating resin 34 which extend to left and right of FIG. 1 and encircle both ends of central conductor 31, the peripheries of the cylindrical sheaths 37, 38 being mutually separated radially to secure a creeping distance of insulation, and external covering portion 34*b* formed by insulating resin 34 covering 31*b*.

Each high-voltage input terminal 30 constitutes an LC filter having the electrostatic capacity of about several tens pF and capable of removing, in cooperation with inductor 28, undesirable noise which leaks from the input side. To obtain sufficient surface creeping withstand voltage characteristics between a pair of central conductors 31 of this magnetron, each insulating resin part 34 has outside cylindrical sheath 37 surrounding the faston terminal and cylindrical sheath 38 located inside the shield box and surrounding the extended part of central conductor 31. In addition, to increase the creeping distance of insulation between a pair of central conductors, annular grooves 39 and 40 are formed in the cylindrical sheaths 37 and 38, respectively.

The structure of single high-voltage input terminal will now be described in the preferred order of assembly.

Figure 3:
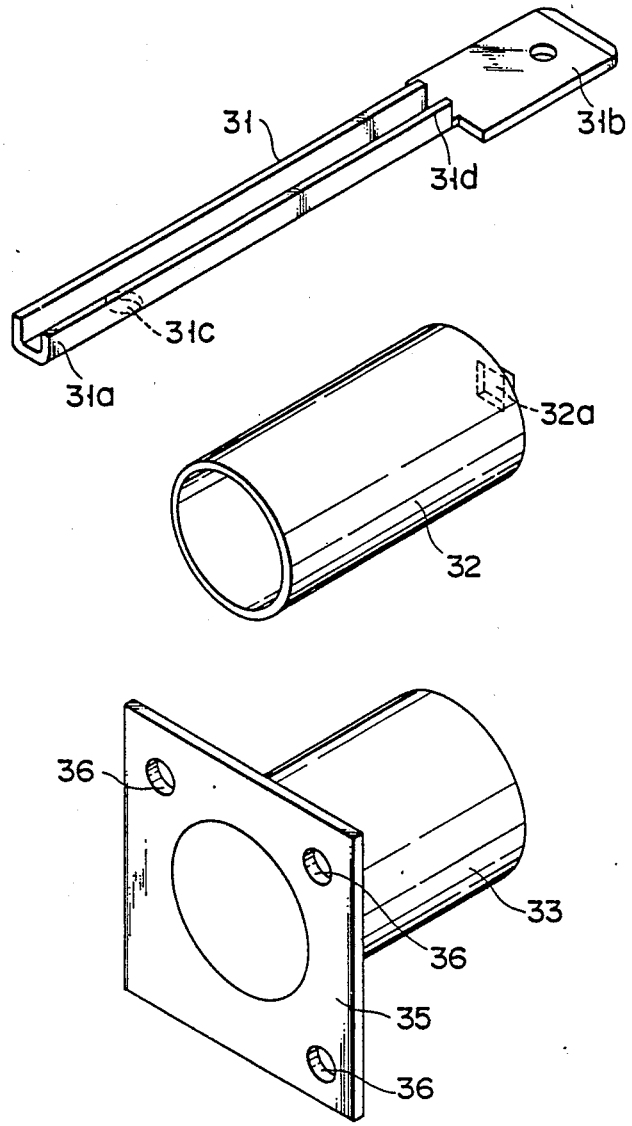
FIG. 3 is a perspective view of individual electrodes to be built into the high-voltage input terminal structure.

First of all, electrode parts are made ready as shown in FIG. 3. Central conductor 31 is made by bending the main part of iron plate of a specified length into a U-shaped cross section and leaving the other end portion to be flat to make faston terminal 31*b*. Hole 31*c* is cut in the part near end portion 31*a* of the U-shaped side to insert the end portion 29*b* of the inductor. Central conductor 31 is in a non-rotation-symmetric form similar to the letter U. This U-shaped structure of the central conductor is helpful in preventing a change in relative position of faston terminal 31*b* and earth electrode 33 which would otherwise occur during resin molding which will be described later. Moreover, the U-shaped structure gives the central conductor higher mechanical strength.

Inner high-potential electrode 32 in a cylinder having a bottom is made ready by deep-drawing iron sheet by a press. This high-potential electrode 32 has square hole 32*a* cut in its bottom, through which central conductor 31 is inserted. After being positioned to be mutually concentric, bottom hole 32*a* of high-potential electrode 32 and that end portion of the U-shaped section which is closer to the Faston terminal are welded together and electrically and mechanically connected. Then, the high-potential electrode and the central electrode are tin-plated. Before subjected to tin-plating, burrs at the end portions of each electrode are removed by tumbling, for example, to improve dielectric strength.

Another electrode part to be made ready is cylindrical earth electrode 33 having flange 35 for mounting to the outside of the shield box. Cylindrical earth electrode 33 is produced by deep-drawing iron plate by a press. Holes 36 are cut in three corners of flange 35. This external earth electrode is nickel-plated.

Figure 4:
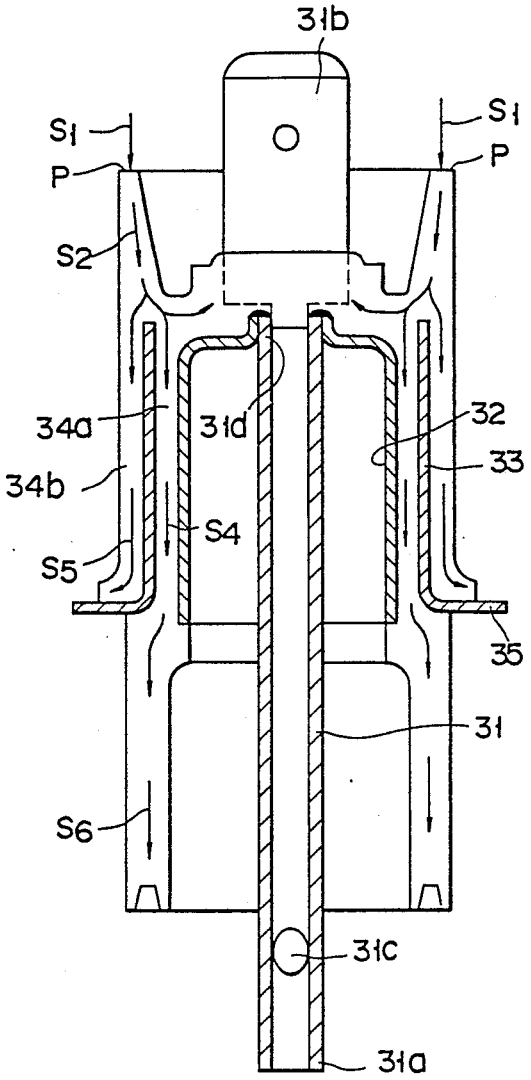
FIG. 4 is a sectional view of the high-voltage input terminal structure showing the flow of resin being filled in the manufacturing process of the high-voltage input terminal structure.

The electrode parts are positioned as shown in FIG. 4 by means of a mold, not shown. Outer earth electrode 33 is arranged outside inner high-potential electrode 32 so as to be mutually concentric, with a gap of about 1 mm, for example, provided between them. The mold, not shown, is in a shape capable of forming the insulating resin part having external surfaces as indicated in the drawings. In molding the insulating resin, resin is injected in the direction as shown by the arrows through 0.9 mm diameter pinpoint gates provided at three positions of the mold, located at the part where a circular end face of cylindrical sheath 37 will be formed of resin, which surrounds faston terminal 31. The insulating resin should preferably be a fire-retardant engineering-plastic such as polybutylene terephthalate (PBT) containing about 30 percent by weight of glass fibers with an average diameter of 30 to 70 μm and an average length of 300 to 500 μm, for example.

Figure 5:
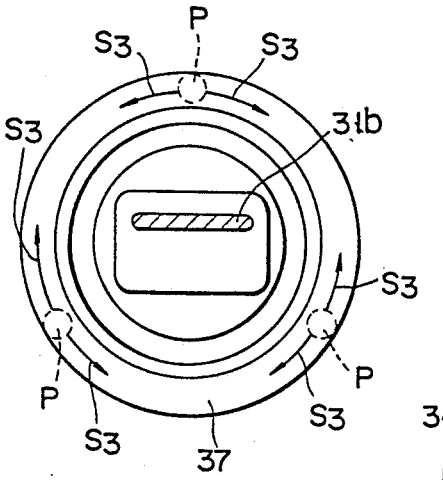
FIG. 5 is a front view of the high-voltage input terminal structure schematically showing the flow of resin being filled in the manufacturing process of the high-voltage input terminal structure.

The resin injected isobarically in the direction of gravity advances in the axial direction as indicated by the arrow S2 in the area around the faston terminal and at the same time, the resin advances in the circumferential direction as indicated by the arrow S3 in FIG. 5. As a result, outside cylindrical sheath 37 surrounding the faston terminal 31*b* is formed. The space for forming this outside cylindrical sheath 37 also serves as a runner to allow resin to move in the circumferential direction in injection molding. Hence, it is possible to let resin flow to the parts involved in maintaining dielectric strength in the condition close to simultaneous injection as if from a ring gate. Outside cylindrical sheath 37 is formed to have a height of 5 to 6 mm, with an end width of 1.3 mm, for example, The injected resin, while flowing around the base portion of faston terminal 31*b*, flows further to the gap between inner and outer cylindrical electrodes 32, 33 as indicated by the arrows S4 and S5 and also to the space around outer electrode 33 under a substantially uniform pressure. The resin passed through the gap between inner and outer electrodes 32, 33 flows to the area of inside cylindrical sheath 38 as indicated by the arrow S6. As has been described, the electrodes are formed and arranged so that the insulating resin can flow basically in one direction vectorially in resin injection. Consequently, the insulating resin layer of the capacitor portion formed between cylindrical high-potential electrode and outside earth electrode which are opposed closely having a common axis and the cylindrical insulating sheaths provided on both sides of the insulating resin of the capacitor and surrounding the central conductor are formed continuously as the resin flows substantially in one direction. As a result, voids are prevented from occurring, making it possible for the insulating resin material to exhibit its withstanding voltage to the full. Part of rectangular flange 35 of earth electrode 33 extends sideways from the insulating resin and is exposed.

The outer periphery of insulating resin 34 of this high-voltage input terminal formed with surface roughness of, 3 μm or less on average, preferably, 1 μm or less on the average. By this, the adhesion of moisture to the surfaces of the insulating resin is effectively impeded, thereby preventing the withstanding voltage of the insulating resin surface from deteriorating over extended periods of service of the magnetron.

Figure 6:
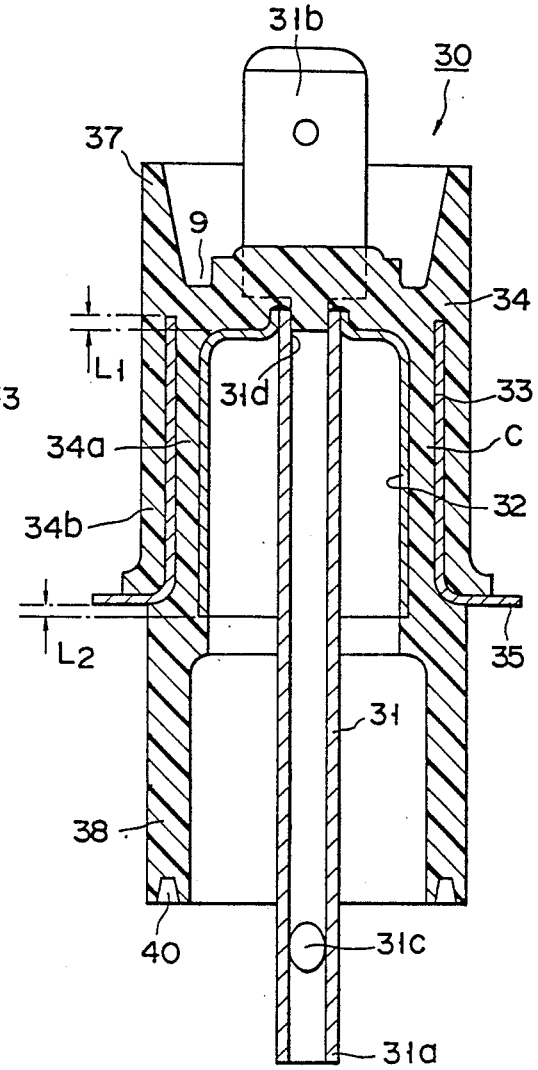
FIG. 6 is a longitudinal sectional view of the high-voltage input terminal structure after resin is filled.
Figure 7:
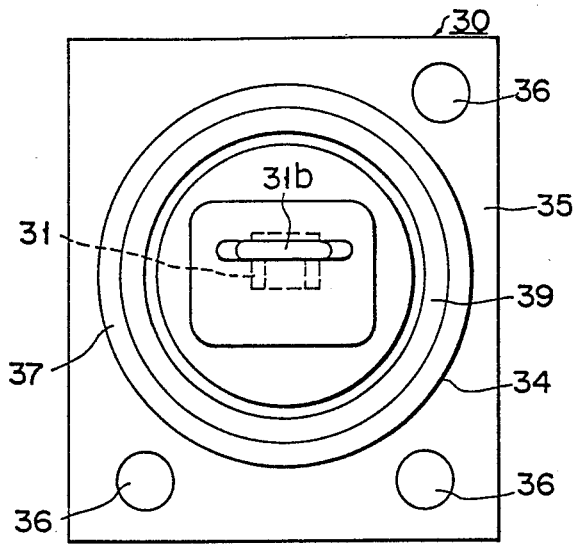
FIG. 7 is a front view of the high-voltage input terminal structure after resin is filled.

By the process described above, high-voltage input terminal 30 is produced, the views of which are shown in FIGS. 6 and 7. For example, when the diameter of inner high-potential electrode 32 is 10 mm, the gap between inner and outer electrodes, forming the capacitor, is 1 mm as described earlier, the axial overlapping length of two electrodes 32, 33 is 13 mm, the length of outside cylindrical sheath 37 is 6 mm and the diameter and length of inside cylindrical sheath 38 are 16 mm and 15 mm, respectively, then the specific inductive capacity of the PBT is about 4. Therefore, the electrostatic capacity between the two electrodes is about 20 pF. The withstanding voltage thereof can be larger than 20 kV of alternating voltage. What is worth mentioning is that the insulating resin part, including capacitor portion 34*a* having an electrostatic capacity, sheaths 37, 38 to secure a creeping distance of insulation and external covering portion 34*b* covering the outer electrode, is formed integrally of a single type of resin. As a result, this insulating resin part precludes the possibility of deterioration in withstanding voltage due to separation at the boundary of different types of resin, making it possible to obtain high-voltage input terminals of stable quality. The use of PBT for the insulating resin ensures that high-voltage input terminal 30 maintains a stable performance up to about 120° C. As a result of various trials, by adjusting the resin molding conditions, high-voltage input terminal 30 could be given dielectric characteristics close to the limiting withstanding voltage of the material.

As shown in FIG. 6, inner and outer electrodes 32, 33 have their ends shifted for specified distances of L1 and L2 with respect to each other in the axial direction and one end of each electrode is formed to have a curved corner. Therefore, even though the gaps between the end portions are relatively narrow, the concentration of electric fields is mitigated, thereby improving the dielectric characteristics.

Figure 8:
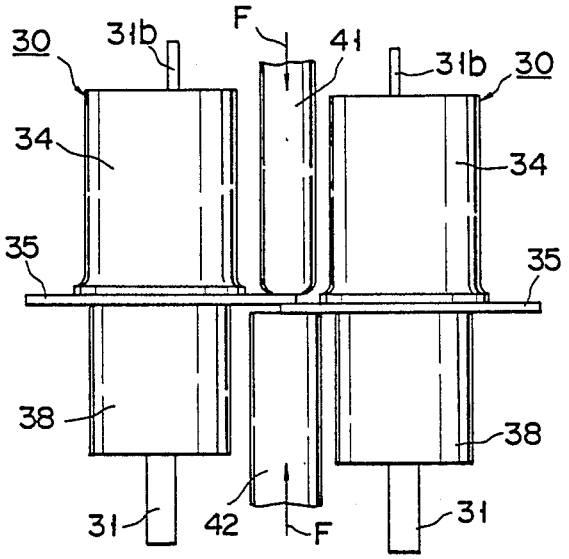
FIG. 8 is a side view showing a process of integrating a pair of high-voltage input terminals.
Figure 9:
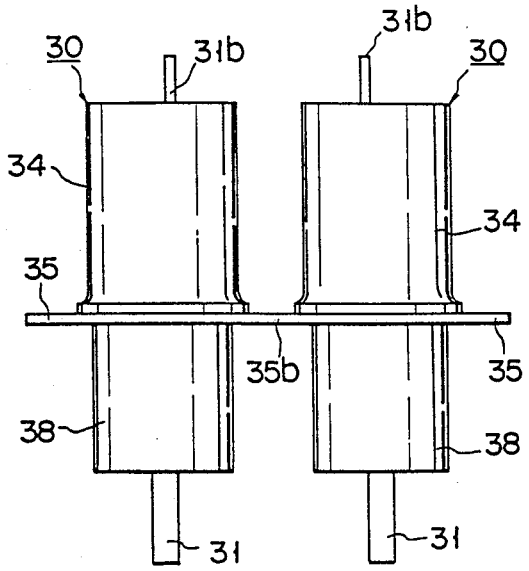
FIG. 9 is a side view showing the completed structure of an integrated high-voltage input terminal.

The flanges of two identical high-voltage input terminals 30 are spliced as follows. As shown in FIG. 8, flanges 35 of two input terminals are laid to overlap each other on their sides which each have one hole 36. The overlapped portions are then placed between pressure welding electrodes 41, 42 and pressurized in the directions of the arrows F. When an electric current is passed through them, the overlapped portions are pressure-welded. In this manner, a double high-voltage input terminal has been completed which has two flanges 35 placed in the same plane and integrated as shown in FIGS. 2 and 9. The fact that flanges are welded after resin molding is completed ensures that a high-voltage input terminal can be obtained which features the accuracy in positioning the high-potential electrode and the earth electrode, which is related to dielectric strength. This is because this method permits the manufacturer to assemble the component parts and fill resin for each input terminal independently and also makes it easy to press each individual earth electrode singly. A pair of high-voltage input terminals has six mounting holes 36. Using these holes, a pair of high-voltage input terminals is secured to the shield box by crimping, for example. By doing so, the flange of this high-voltage input terminal is attached tightly to the shield box, precluding the possibility of leakage of electric waves.

Figure 10:
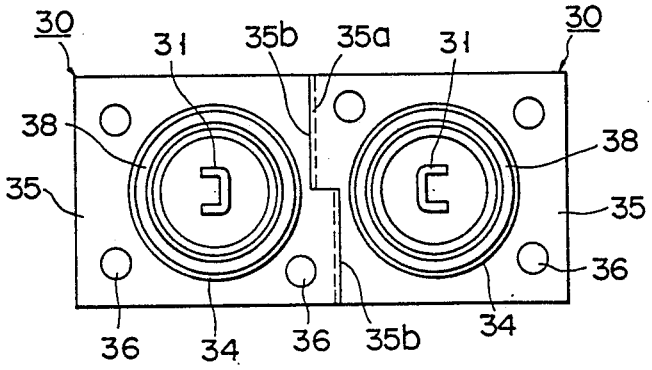
FIG. 10 is a front view showing a high-voltage input terminal structure according to a modification of this invention.

In a modification shown in FIG. 10, earth electrode flanges 35 of two high-voltage input terminals 30 are formed to have crank-shaped edges **35*b***. These edges are butted together and welded in a body. Since in this case the edges of the flanges which are to be joined can be recognized easily, if this method is used, it is easy to automate the assembly process.

Figure 11:
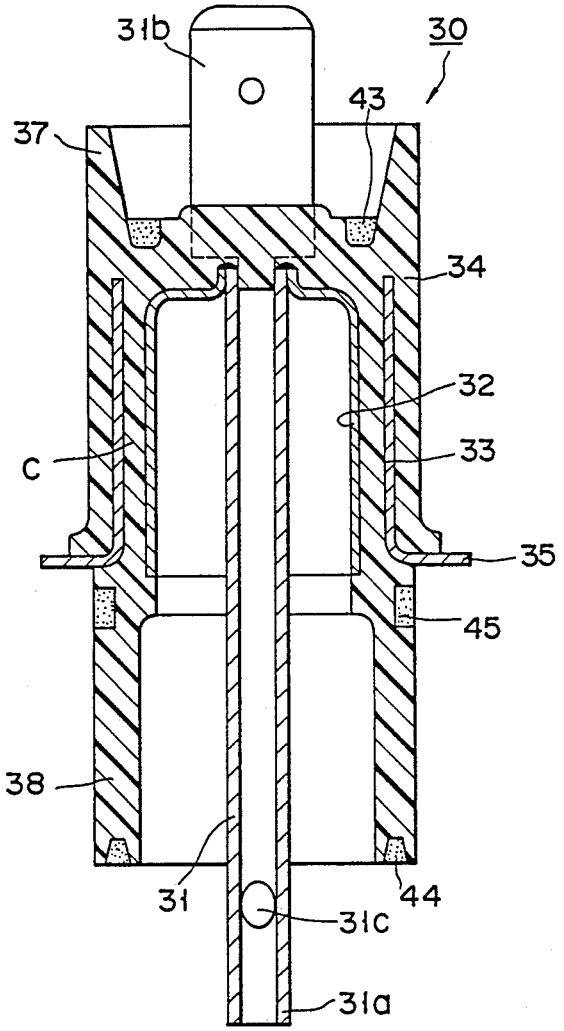
FIGS. 11 and 12 are longitudinal sectional views showing high-voltage input terminal structures according to other modifications of this invention.

In another modification shown in FIG. 11, the annular grooves of the sheaths and a part of the inside sheath are filled with annular barriers 43, 44 and 45 of a resin material superior in tracking characteristics to insulating resin 34, such as an epoxy resin or a silicone rubber. Therefore, even if electric discharge occurs on the surface, the carbonizing course of the insulating resin surface is blocked by these barriers, thereby preventing the continuation of the discharge. Even when dew condenses on the surface of the resin portion, the dielectric characteristics are impeded from deteriorating. The annular barriers may be formed so as to project a little from the insulating resin surface. By doing so, the advantage of the barrier formation can be increased.

Figure 12:
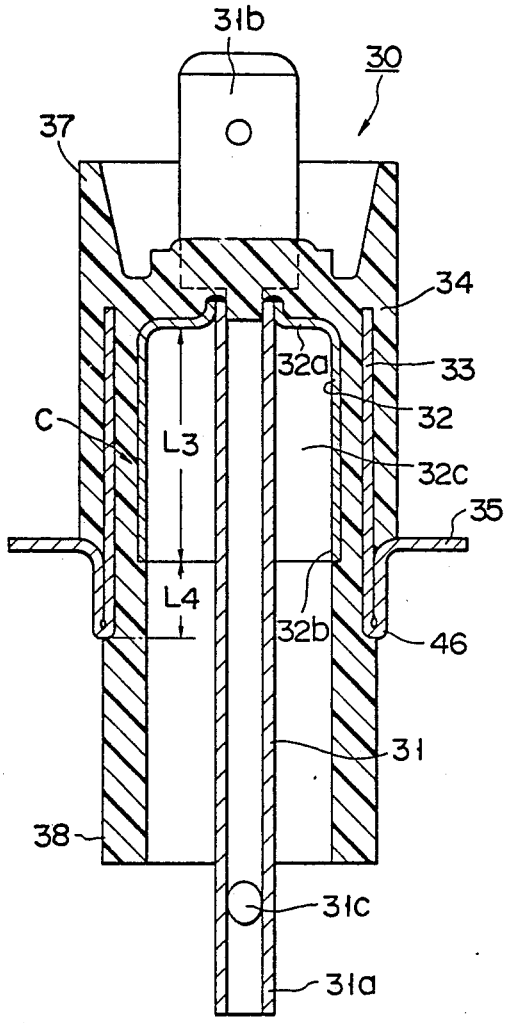

In a modification shown in FIG. 12, there is folded part 46 which is formed by turning up the end portion of outer earth electrode to the outside. The folded part is further turned and expanded outwards from its middle position, thus forming flange 35 for mounting to the shield box. The length L3 of inner high-potential electrode 32 is decided to be about ½ of the third harmonic wavelength. The opening end part **32*b* of the inner electrode is located inside a specified distance L4 from the end of the folded part 46 of outer earth electrode 33. Looking at the structure of the high-voltage input terminal from the side of the oscillator body from the viewpoint of circuit, there is formed choke groove 32*c*, which shows a high impedance against the third harmonic wave, between inner high-potential electrode 32 and central conductor 31 located inside electrode 32**. The choke groove offers an additional effect of impeding the external leakage of this harmonic component.

The length L3 of inner high-potential electrode 32, that is, the depth of the choke groove may be changed to a dimension capable of choking not only the third harmonic wave but also other harmonic waves. Or otherwise, one or more cylindrical conductors of different lengths may be connected coaxially in the inside of this inner high-potential electrode 32 and a plurality of choke grooves may be formed that can choke a plurality of harmonic waves that you select. Also in this embodiment, resin **34*a* of the capacitor portion C and cylindrical sheaths 37, 38**, all consisting of an insulating resin, are arranged substantially along a straight line.

Figure 13:
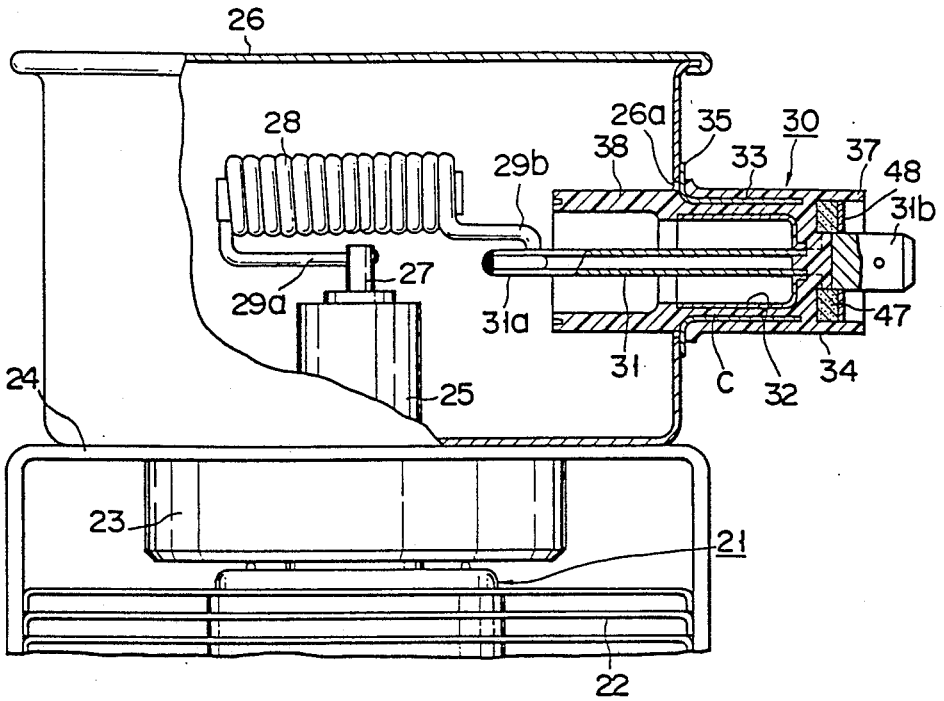
FIG. 13 is a longitudinal sectional view showing a high-voltage input terminal structure in still another embodiment of this invention.
Figure 14:
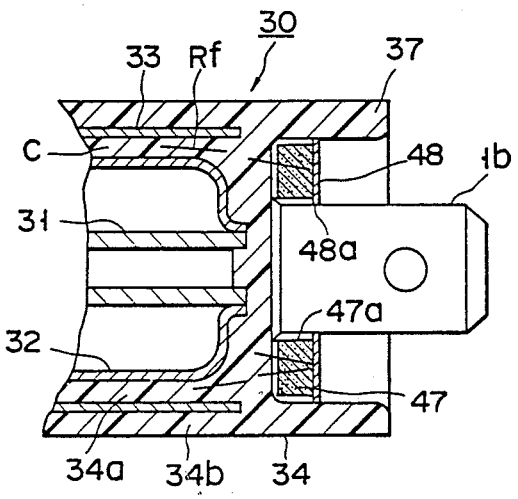
FIG. 14 is a fragmentary view, on an enlarged scale, of a portion of the high-voltage input terminal structure of FIG. 13.
Figure 15A:
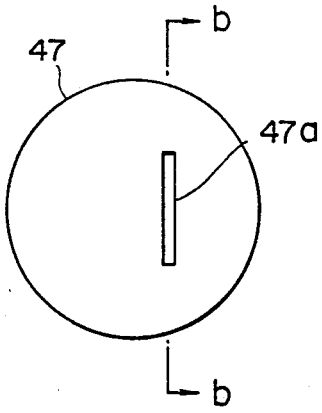
FIGS. 15*a* and 15*b* are a plan view and a sectional view along line b—b of a portion of the high-voltage input terminal structure shown in FIGS. 13 and 14.
Figure 15B:
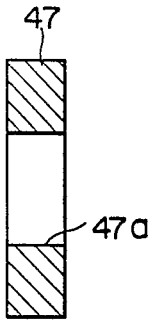

In an embodiment of this invention, shown in FIGS. 13, 14, **15*a* and 15*b*, high-frequency wave absorbing material 47 is fitted in the part close to that side end part of the capacitor portion C of high-voltage input terminal which is to be connected to an external circuit, that is to say, in the base part of faston terminal 31*b* which is the outer terminal of central conductor 31. High-frequency wave reflecting conductor 48 is closely attached to the outer side of high-frequency wave absorbing material 47. High-frequency wave absorbing material 47 is made of a disc of a material that absorbs microwaves, such as ferrite, ceramics like silicone nitride (SiC), carbon and so called polyiron which is formed by molding ferromagnetic particles with an organic insulative material. The high-frequency wave absorbing material has hole 47*a* formed, through which faston terminal 31*b* is inserted into a specified position. High-frequency wave reflecting conductor 48 is of an adequate thin metal sheet, such as aluminium and stainless steel and has the same diameter as the absorbing material and has hole 48*a*** formed. This reflecting conductor may be another piece of absorbing material, one wide of which is covered with a thin conducting film.

According to this embodiment, a part of high-frequency waves which is going to lead from the input terminal to the outside as indicated by the arrow Rf in FIG. 14 is absorbed by high-frequency wave absorbing material 47 and at the same time, another part of high-frequency waves is reflected by high-frequency wave reflecting conductor 48 and gets absorbed again by the absorbing material. In this manner, the external leakage is effectively impeded. This absorbing action of high-frequency waves is very effective in absorbing the second harmonic wave, the third harmonic wave and spurious components with frequencies close to those of these higher harmonics.

The outer diameter of high-frequency wave absorbing material 47 or high-frequency wave reflecting conductor 48 contacted to the outer surface of material 47 at the outer terminal side is larger than that of inner high-potential electrode and preferably equal to or slightly larger than the inner diameter of inner high-potential electrode 32. Absorbing material 47 and reflecting conductor 48 are fitted into the inside of cylindrical sheath 37. Thus, high frequency wave components Rf passing through resin capacitor section C can be effectively absorbed by high-frequency wave absorbing material 47.

High frequency wave absorbing material 47 and high frequency wave reflecting conductor 48 may be formed on the inside of capacitor section C at the inductor side or may be formed in both of the sheath 37 and capacitor section C.

Figure 16:
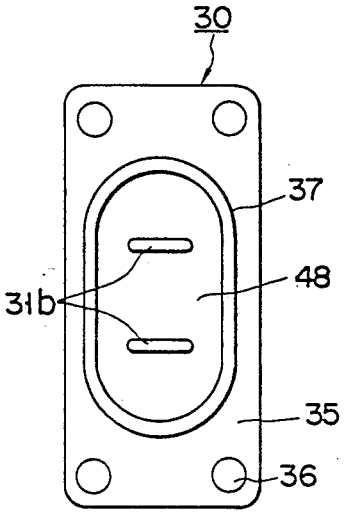
FIGS. 16 and 17 are a side view and a perspective view showing a high-voltage input terminal structure according to yet another embodiment of this invention.
Figure 17:
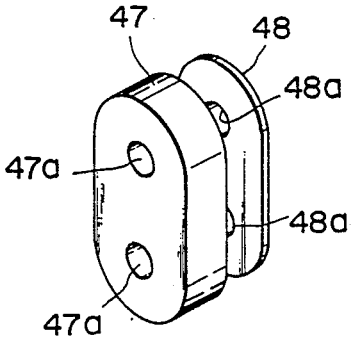

In high-voltage input terminal 30 in an embodiment shown in FIGS. 16 and 17, two capacitor portions have been integrated. High-frequency wave absorbing material 47 having two holes **47*a* and high-frequency wave reflecting conductor 48 having two holes 48*a* are closely put together and fitted in the base part of faston terminal 31***b*.

Figure 18:
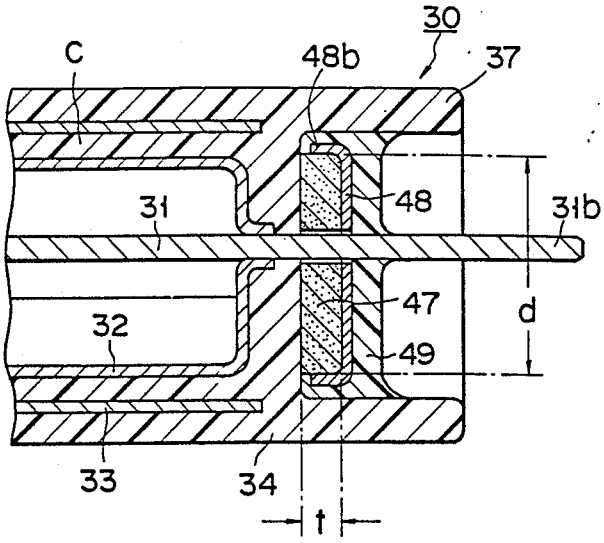
FIG. 18 is a fragmentary sectional view, on an enlarged scale, of a portion showing a high-voltage input terminal structure according to a still further embodiment of this invention.
Figure 19:
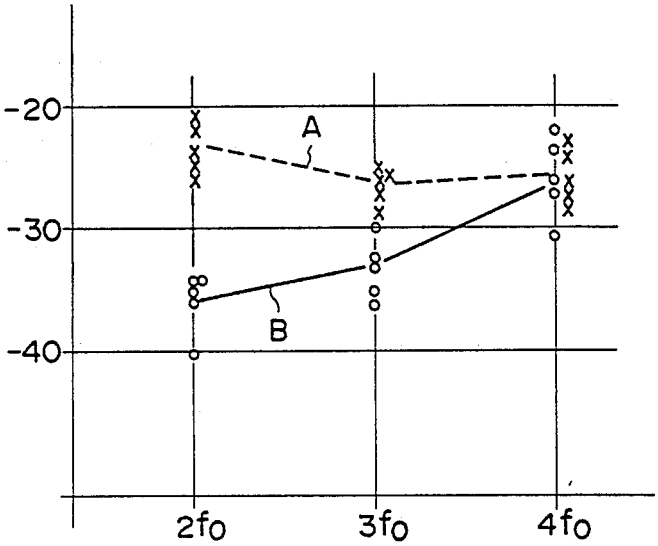
FIG. 19 is a characteristic diagram comparing the harmonic leakage levels between a conventional high-voltage input terminal structure and the high-voltage input terminal structure according to an embodiment of this invention.

In an embodiment shown in FIG. 18, the outer side face and the outer periphery of high-frequency wave absorbing material 47 of high-voltage input terminal 30 are covered by dish-shaped high-frequency wave reflecting conductor 48 having short cylindrical part 48*b*. The absorbing material and the reflecting conductor are fitted onto the central conductor. High-frequency wave absorbing material 47 and high-frequency wave reflecting conductor 48 are buried in covering 49. In this embodiment, the outer diameter of high-frequency wave absorbing material 47 or high-frequency wave reflecting conductor 48 contacted to the outer surface of absorbing material at external connecting terminal side is also larger than that of high-potential inner cylindrical electrode 48 and absorbing material 47 and reflecting conductor 48 are also provided in the inside of cylindrical sheath 37. FIG. 19 shows the measurement result of high-frequency wave leakage level when the outer diameter of high-potential inner cylindrical electrode 32 is 11 mm and the outer diameter d of high-frequency wave absorbing material 47 is 12 mm and its thickness is 1.5 mm in the structure of FIG. 18. Measurements were made of external leakage levels of the second harmonic wave (2 fo), the third harmonic wave (3 fo) and the fourth harmonic wave (4 fo) of oscillation fundamental waves when the frequency fo was 2450 MHz. The curve A indicates the leakage levels of harmonic waves that leak to the external power source side of five magnetrons which were not provided with high-frequency wave absorbing material and high-frequency wave reflecting conductors. On the other hand, the curve B indicates the measurement results for five magnetrons which were each provided with high-frequency wave absorbing material and high-frequency wave reflecting conductors. As is evident from a comparison of these two curves, those with high-frequency wave absorbing material and high-frequency wave reflecting conductors show notable effects in suppressing the second and third harmonic components, in particular. Therefore, they also give conspicuous effects in suppressing spurious components in the neighborhood of this frequency.

As set forth hereinabove, according to this invention, it is possible to provide molded insulating resin parts which have a structure of good quality as can be confirmed under microscopic point of view and can withstand mechanical stresses, even though the insulating resin, which provides high-voltage input terminals with an electrostatic capacity and a dielectric function, is used in a thin layer. This is because, according to this invention, the basic flow of resin is in one direction vectorically and the resin flow is hardly accompanied by sudden changes in the flow direction and changes in the sectional area of the flow. In addition, since the occurrence of voids is effectively inhibited, the insulating resin parts according to this invention can fully exhibit the dielectric performance inherent in the resin material itself.

Accordingly, using relatively simple high-voltage input terminals, it is possible to provide magnetrons for electronic ranges, which are superior in dielectric characteristics and which hardly allow high-frequency waves to leak to the external power source circuit.

What is claimed is:

1. A high-voltage input terminal structure of a magnetron for a microwave oven, said magnetron including a magnetron body having a cathode lead terminal for supplying power to the magnetron body and a shield box enclosing the cathode lead terminal, comprising:

a cylindrical earth electrode having one end secured to the shield box;

a cylindrical high potential inner electrode having a cover section provided with an insertion bore and coaxially arranged in said cylindrical earth electrode with a gap therebetween;

a central conductor fitted in the insertion bore, electrically connected to the inner electrode, longitudinally extending in said cylindrical high-potential electrode and having one end and the other end as an external terminal;

an inductor connected between the cathode lead terminal and one end of the central conductor;

an insulating resin layer for defining a capacitor portion, which is formed by a resin filled in the gap, in one direction vectorially so as to prevent the occurrence of cracks and voids, between the cylindrical earth electrode and the high-potential electrode; and cylindrical insulating sheaths formed with the insulating resin layer by the resin, extending from both sides of the insulating resin layer, covering a part of the cylindrical earth electrode and having a cup section in which a part of the central conductor is located to electrically insulate the central electrode from the cylindrical earth electrode, the insulating resin layer and the cylindrical insulating sheaths being continuously formed and substantially extending along a straight line.

2. The high-voltage input terminal structure according to claim 1, wherein the insulating resin of said high-voltage input terminal is polybutylene terephthalate containing glass wool.

3. The high-voltage input terminal structure according to claim 1, further comprising tracking barriers which are provided, in the periphery of the insulating resin portion, and are formed of an insulating material superior in tracking resistance to the insulating resistance portion.

4. The high-voltage input terminal structure according to claim 1, further comprising a high-frequency wave absorbing material which is provided close to the end part of the capacitor portion and around the central conductor and a high-frequency wave reflecting conductor which is mounted on an outer side of said absorbing material in contact therewith.

5. The high-voltage input terminal structure according to claim 4, wherein said high-frequency wave absorbing material and said high-frequency wave reflecting conductor are provided on an external terminal side of the capacitor portion in the cylindrical insulating sheath.

6. The high-voltage input terminal structure according to claim 4, wherein said high-frequency wave absorbing material is covered on its outer surface with a high-frequency wave reflecting conductor at an external connecting terminal side.

7. The high-voltage input terminal structure according to claim 5, wherein an outer diameter of one of the high-frequency wave absorbing material and the high-frequency wave reflecting conductor is larger than that of the high potential inner electrode.

8. The high-voltage input terminal structure according to claim 6, wherein an outer diameter of one of the high-frequency wave absorbing material and the high-frequency wave reflecting conductor is larger than that of the high potential inner electrode.

9. The high-voltage input terminal structure according to claim 5, wherein an outer diameters of the high frequency wave absorbing member and the high frequency wave reflecting conductor are substantially equal to or slightly larger than an inner diameter of the outer cylindrical earth electrode.

10. The high-voltage input terminal structure according to claim 6, wherein an outer diameters of the high frequency wave absorbing member and the high frequency wave reflecting conductor are substantially equal to or slightly larger than an inner diameter of the outer cylindrical earth electrode.

11. The high-voltage input terminal structure according to claim 1, wherein the cylindrical high-potential electrode and the earth electrode are positioned a specified distance shifted with respect to each other from their ends.

12. The high-voltage input terminal structure according to claim 11, wherein an outer diameters of the high frequency wave absorbing member and the high frequency wave reflecting conductor are substantially equal to or slightly larger than an inner diameter of the outer cylindrical earth electrode.

13. The high-voltage input terminal structure according to claim 11, wherein an end of the opening of an earth electrode projects outwards in the axial direction beyond an end of the opening of the cylindrical high-potential electrode.

14. The high-voltage input terminal structure according to claim 1, wherein the cylindrical high-potential electrode is provided with at least one choke grooves of a longitudinal length corresponding to about $\frac{1}{4}$ of a wavelength of one or more harmonic waves.

15. The high-voltage input terminal structure according to claim 14, wherein an end of the opening of an earth electrode projects outwards in the axial direction beyond an end of the opening of the cylindrical high-potential electrode.

16. The high-voltage input terminal structure according to claim 1, wherein one end portion of the earth electrode is turned up to the outside and extended sideways to form a flange to secure said earth electrode to a wall of said shield box.

17. The high-voltage input terminal structure according to claim 1, wherein an outside surface of the insulating resin has a surface roughness of no more than 3 $\mu$m on average.

18. A high-voltage input terminal structure of a magnetron for a microwave oven, said magnetron including a magnetron body having a cathode lead terminal for supplying power to the magnetron body and a shield box enclosing the cathode lead terminal, comprising:

a cylindrical earth electrode having one end secured to the shield box;

a cylindrical high potential inner electrode having a cover section provided with an insertion bore and coaxially arranged in said cylindrical earth electrode with a gap therebetween;

a central conductor fitted in the insertion bore, electrically connected to the inner electrode, longitudinally extending in said cylindrical high-potential electrode and having one end and the other end as an external terminal;

an inductor connected between the cathode lead terminal and one end of the central conductor;

an insulating resin layer for defining a capacitor member, which is formed by a resin containing glass wools filled in one direction vectorially in the gap between the cylindrical earth electrode and the high-potential electrode; and cylindrical insulating sheaths formed with the insulating resin layer by the resin, extending from both sides of insulating resin layer, covering a part of the cylindrical earth electrode and having a cup section in which a part of the central conductor is located to electrically insulate the central electrode from the cylindrical earth electrode, the insulating resin layer and the cylindrical insulating sheaths being continuously formed and substantially extending to a straight line and the glass wools being substantially arranged along the straight line in the insulating resin layer and the cylindrical insulating sheaths.

* * * * *